US007967557B2

(12) United States Patent
Okamoto et al.

(10) Patent No.: US 7,967,557 B2
(45) Date of Patent: Jun. 28, 2011

(54) MULTIBLADE CENTRIFUGAL BLOWER

(75) Inventors: Kazuki Okamoto, Tokyo (JP); Hitoshi Kikuchi, Tokyo (JP); Yasuyoshi Makino, Tokyo (JP); Hidetoshi Yamato, Tokyo (JP); Shoji Yamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 930 days.

(21) Appl. No.: 11/911,157

(22) PCT Filed: Jan. 29, 2007

(86) PCT No.: PCT/JP2007/051395

§ 371 (c)(1),
(2), (4) Date: Oct. 10, 2007

(87) PCT Pub. No.: WO2008/093390

PCT Pub. Date: Aug. 7, 2008

(65) Prior Publication Data

US 2009/0263240 A1 Oct. 22, 2009

(51) Int. Cl.
*F04D 29/30* (2006.01)

(52) U.S. Cl. ..... 415/173.1; 415/205; 416/185; 416/228; 416/241 R; 416/223 B

(58) Field of Classification Search ..... 415/173.1, 415/205; 416/185, 186 R, 228, 241 R, 223 B
See application file for complete search history.

(56) References Cited

U.S. PATENT DOCUMENTS

| | | | | |
|---|---|---|---|---|
| 1,341,882 | A * | 6/1920 | Criqui | 416/186 R |
| 3,217,976 | A * | 11/1965 | Downs | 415/161 |
| 3,650,633 | A * | 3/1972 | Benoit | 415/143 |
| 4,859,140 | A * | 8/1989 | Passadore | 415/48 |
| 5,813,831 | A | 9/1998 | Matsunaga et al. | |
| 7,331,758 | B2 | 2/2008 | Arinaga et al. | |
| 2002/0021967 | A1 | 2/2002 | Kim et al. | |

FOREIGN PATENT DOCUMENTS

| | | |
|---|---|---|
| AU | 2005260828 A1 | 1/2006 |
| JP | 53 89607 | 7/1978 |
| JP | 57 51193 | 3/1982 |
| JP | 5-172097 | 7/1993 |
| JP | 10 54400 | 2/1998 |
| JP | 10 311294 | 11/1998 |
| JP | 2001 65493 | 3/2001 |
| JP | 2002 61597 | 2/2002 |
| JP | 2004 245087 | 9/2004 |

(Continued)

*Primary Examiner* — Ninh H Nguyen
(74) *Attorney, Agent, or Firm* — Oblon, Spivak, McClelland, Maier & Neustadt, L.L.P.

(57) ABSTRACT

A multiblade centrifugal blower includes a centrifugal fan including a hub rotated by a motor, and plural curved rectangular blades arranged at predetermined intervals in a circumferential direction of the hub forming a cylindrical basket with an opening on a front side of the hub, and a scroll casing including an air inlet and an air outlet, and houses the centrifugal fan inside to face the air inlet. A length from a rear end to an front end of an outer edge of the blade is shorter than a length from a rear end to an front end of an inner edge of the blade, and a bell mouth is configured such that distance between a tip part of the inner edge of the blade and an inner wall of the scroll casing is the minimum at an inner tip part P of the bell mouth of the air inlet.

11 Claims, 5 Drawing Sheets

FOREIGN PATENT DOCUMENTS

| | | | |
|---|---|---|---|
| JP | 2004 353665 | | 12/2004 |
| JP | 2005 36736 | | 2/2005 |
| JP | 2006 194245 | | 7/2006 |
| TW | I274814 | | 3/2007 |
| WO | WO 2006/006668 | A1 | 1/2006 |
| WO | WO 2006/126408 | A1 | 11/2006 |

* cited by examiner

MULTIBLADE CENTRIFUGAL BLOWER

TECHNICAL FIELD

The present invention relates to a multiblade centrifugal blower used in a ventilation apparatus, an air-conditioning apparatus, and the like.

BACKGROUND ART

When air is sucked into a cylindrical basket-shaped centrifugal fan of a multiblade centrifugal blower, because inertial force acts on the sucked-in air, the sucked-in air flows towards the hub of the centrifugal fan. There is a space between neighboring blades of the centrifugal fan (hereinafter, "blade space"). Due to the flow of the sucked-in air towards the hub, a reverse flow of air is created inside the centrifugal fan in the space between the blade space that is close to the air inlet, and the reverse flow of the air blocks the main flow of the sucked-in air. Furthermore, a secondary flow of air is created along an inner wall inside a scroll casing of the centrifugal fan causing deterioration in performance of the multiblade centrifugal blower.

A conventional multiblade centrifugal blower (for example, see Patent Document 1) includes a centrifugal fan and a scroll casing that houses the centrifugal fan. The centrifugal fan rotates around a rotation shaft, which extends vertically, sucks in air from the direction of the rotation shaft, and blows the sucked-in air in a circumferential direction. The scroll casing includes an air inlet on an upper wall, a casing main body with a spiral air passage around the centrifugal fan, and a cylindrical exhaust. The cylindrical exhaust, which protrudes from a peripheral part of the casing main body, communicates with the air passage and forms a tongue in the peripheral part of the casing main body. Near the tongue formed in the scroll casing, a rectifying rib is arranged to guide the air, which is likely to flow in a reverse direction from a space between the top part of the centrifugal fan and the scroll casing towards the air inlet, in blowing direction. This configuration leads to reduction in noise.

Another conventional multiblade centrifugal blower includes a centrifugal fan and a scroll casing (for example, see Patent Document 2). The centrifugal fan includes a hub that rotates around a shaft center, a plurality of blades that are arranged at predetermined intervals in a circumferential direction of the hub, and a ring located on the opposite side of the hub to reinforce the blades. The scroll casing includes an air inlet, and houses inside the centrifugal fan such that the centrifugal fan is rotatable. A depressed portion of a predetermined depth, that is, a bell mouth is arranged circumjacent to the air inlet of the scroll casing. The air inlet-end located on the opposite side of the blades on the hub does not have shroud, and is rotatably inserted inside the recess of the bell mouth. Thus, noise is reduced in the conventional multiblade centrifugal blower.

Patent Document 1: Japanese Patent Application Laid-Open No. 2004-245087

Patent Document 2: Japanese Patent Application Laid-Open No. 2004-353665

DISCLOSURE OF INVENTION

Problem to be Solved by the Invention

In the conventional multiblade centrifugal blower, it is possible to reduce the reverse flow of the air and noise. However, due to reduction in the spatial volume inside the scroll casing, or due to reduction in the effective volume of the scroll casing because of generation of a new secondary flow adjacent to the rectifying rib or the bell mouth, the blowing performance of the multiblade centrifugal blower deteriorates.

The present invention is achieved in view of the foregoing, and it is an object of the present invention to obtain a multiblade centrifugal blower that can reduce noise without deterioration in blowing performance of the multiblade centrifugal blower. Furthermore, it is an object of the present invention to obtain a multiblade centrifugal blower that can reduce the adverse effect of the secondary flow inside the scroll casing.

Means for Solving Problem

To solve the above problems, and to achieve the above objects, a multiblade centrifugal blower includes a centrifugal fan that includes a hub that is rotated by a motor; and a plurality of curved rectangular blades that are arranged at predetermined intervals in a circumferential direction of the hub to form a cylindrical basket with an opening on a front side of the hub; and a scroll casing that includes an air inlet and an air outlet, and houses the centrifugal fan inside such that the centrifugal fan faces the air inlet, wherein rotation of the centrifugal fan causes suction of air from an opening on the front side of the hub toward a direction of a rotating shaft of the motor, and causes discharge of the air through a space between the blades in a centrifugal direction so that the air is blown out from the air outlet, a length $B_2$ from a rear end to an front end of an outer edge of the blade is shorter than a length $B_1$ from a rear end to an front end of an inner edge of the blade, and a bell mouth is located at the air inlet such that a distance from a tip part of the inner edge of the blade to an inner wall of the scroll casing is minimum at an inner tip part of the bell mouth.

EFFECT OF THE INVENTION

According to the present invention, it is possible to reduce interference between blades of a centrifugal fan and reverse flow of air inside the multiblade centrifugal blower, and to reduce noise without deterioration in performance of the multiblade centrifugal blower.

BRIEF DESCRIPTION OF DRAWINGS

FIG. 5-1 is an enlarged vertical section view of a shape of a first example of a bell mouth.

FIG. 5-2 is an enlarged vertical section view of a shape of a second example of a bell mouth.

FIG. 5-3 is an enlarged vertical section view of a shape of a third example of a bell mouth.

FIG. 8-1 is an enlarged vertical section view of a shape of a first example of a front end of the blade.

FIG. 8-2 is an enlarged vertical section view of a shape of a second example of a front end of the blade.

FIG. 8-3 is an enlarged vertical section view of a third example of a shape of a front end of the blade.

EXPLANATIONS OF LETTERS OR NUMERALS

1 Multiblade centrifugal blower
2 Motor
3 Centrifugal fan
4 Scroll casing
4*a* Air inlet
4*b* Air outlet
4*x* Bell mouth
5 Hub
6 Blade
6*a* Inner edge of blade
6*b* Outer edge of blade
6*x* Pressurized surface
7 Ring (blade reinforcing member)

BEST MODE(S) FOR CARRYING OUT THE INVENTION

Exemplary embodiments of a multiblade centrifugal blower according to the present invention are explained in detail below with reference to the accompanying drawings.

Figure 1:
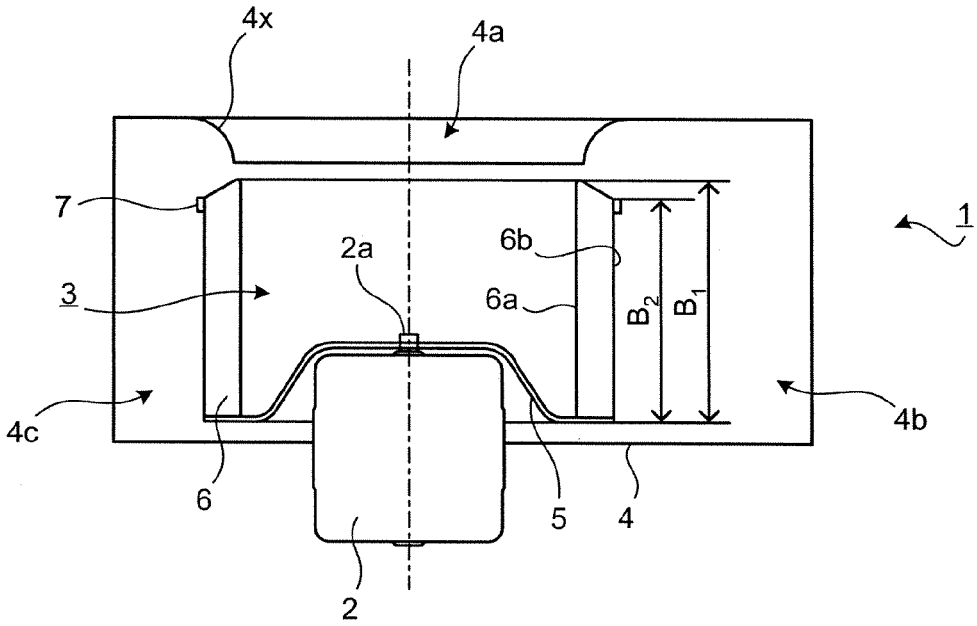
FIG. 1 is a vertical cross section of a multiblade centrifugal blower according to an embodiment of the present invention.
Figure 2:
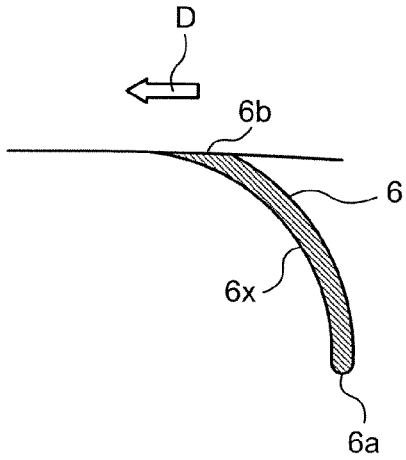
FIG. 2 is a cross section of a blade of a centrifugal fan.
Figure 3:
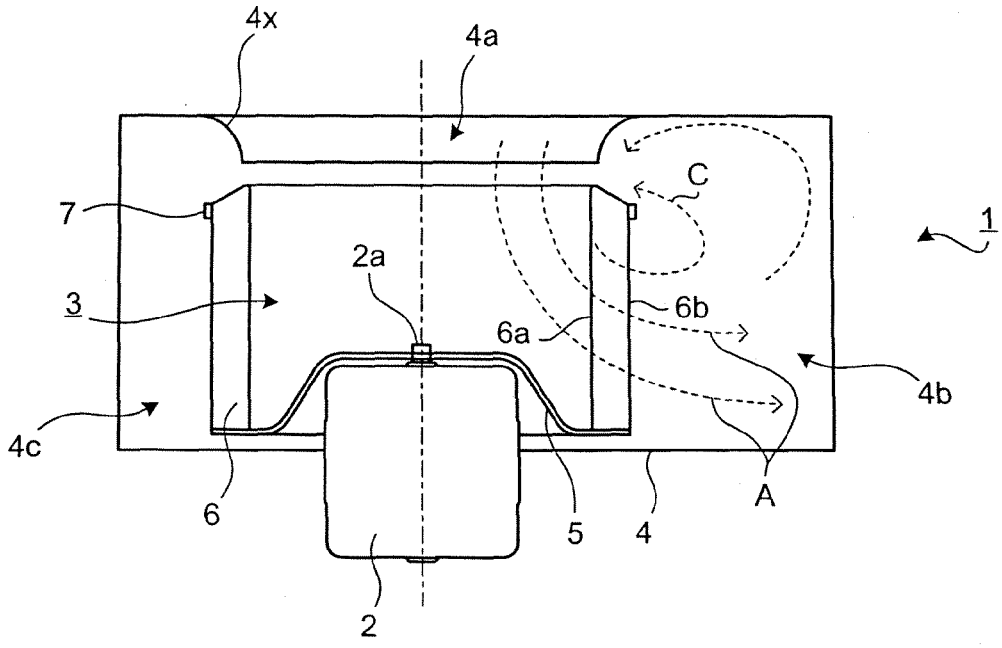
FIG. 3 is a vertical cross section indicating flow of sucked-in air inside the multiblade centrifugal blower according to the embodiment.
Figure 4:
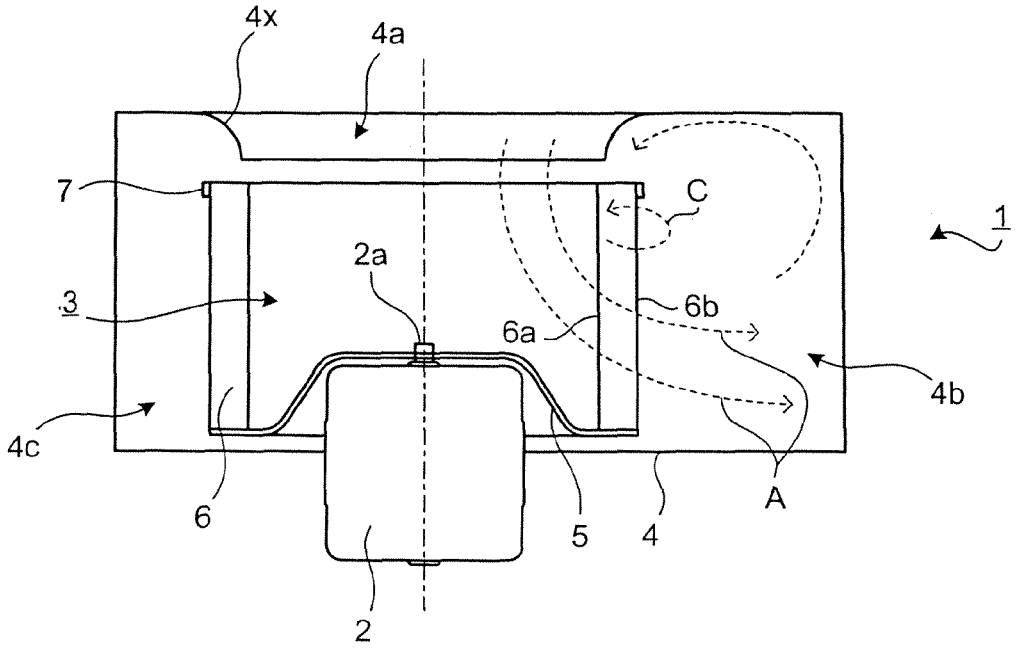
FIG. 4 is a vertical cross section indicating flow of air inside a conventional multiblade centrifugal blower as a comparative example.
Figures 1, 5:
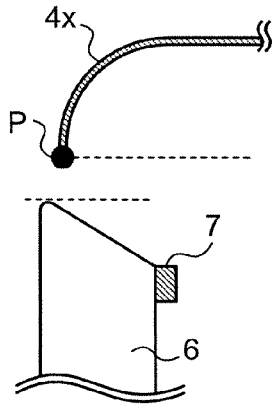
Figures 2, 5:
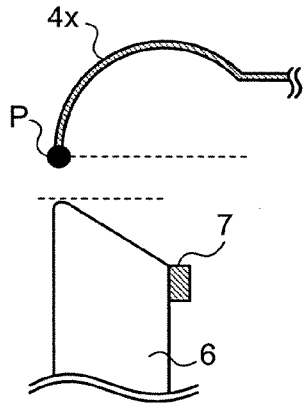
Figures 3, 5:
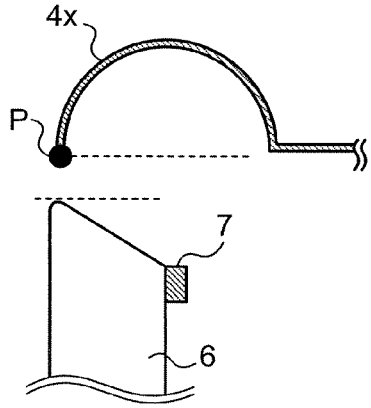
Figure 6:
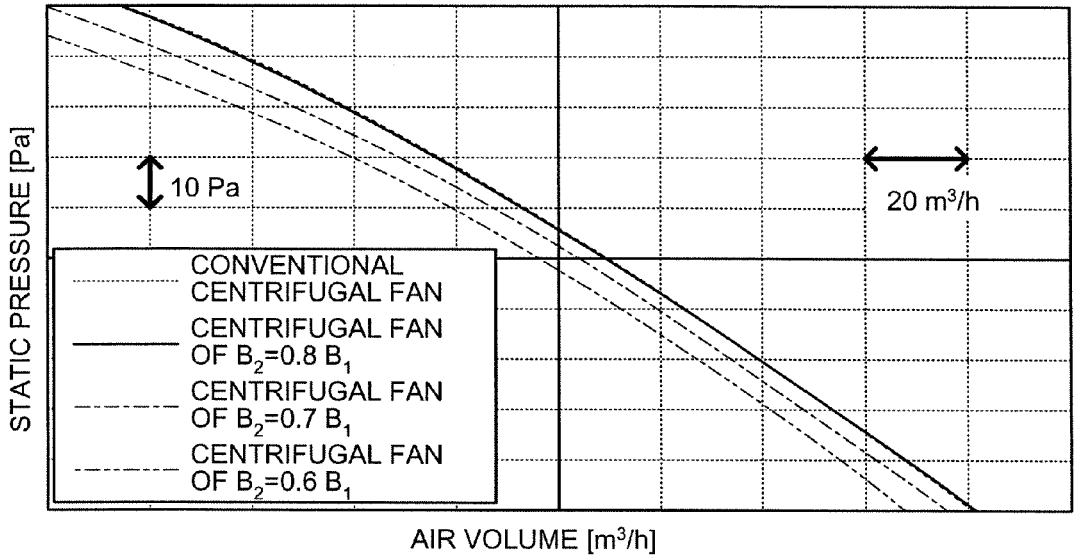
FIG. 6 is a graph of air discharging performance when a length $B_2$ of an outer edge of the blade is changed.
Figure 7:
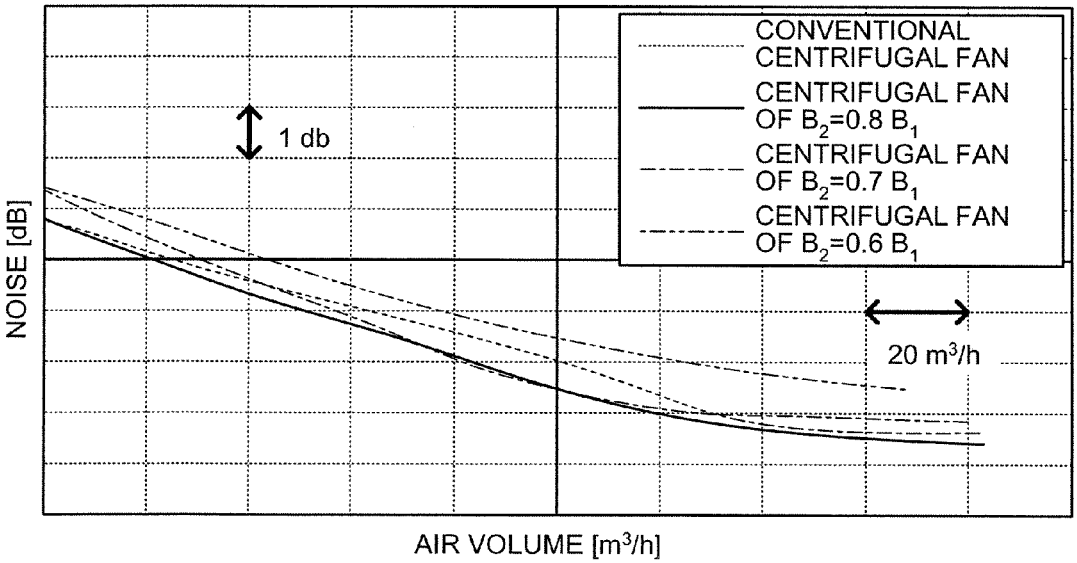
FIG. 7 is a graph of noise when the length $B_2$ of the outer edge of the blade is changed.
Figures 1, 8:
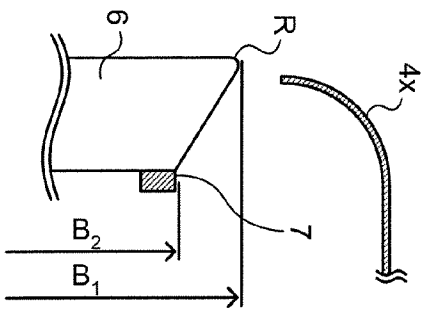
Figures 2, 8:
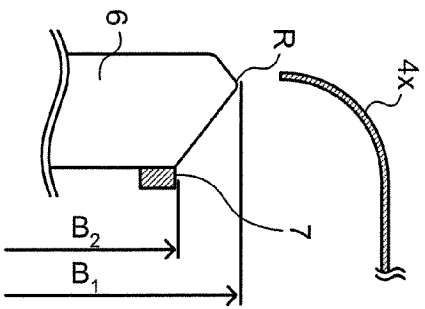
Figures 3, 8:
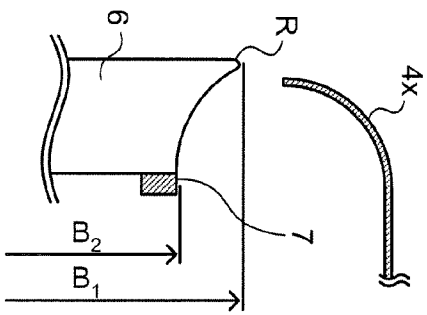

FIG. 1 is a vertical cross section of the multiblade centrifugal blower according to an embodiment of the present invention. FIG. 2 is a cross section of a blade of a centrifugal fan. FIG. 3 is a vertical cross section indicating flow of sucked-in air inside the multiblade centrifugal blower according to the embodiment. FIG. 4 is a vertical cross section indicating flow of air inside a conventional multiblade centrifugal blower shown as a comparative example. FIG. 5-1 is an enlarged vertical section view of a shape of a first example of a bell mouth. FIG. 5-2 is an enlarged vertical section view of a shape of a second example of a bell mouth. FIG. 5-3 is an enlarged vertical section view of a shape of a third example of a bell mouth. FIG. 6 is a graph of air discharging performance when a length $B_2$ of an outer edge of the blade is changed. FIG. 7 is a graph of noise when the length $B_2$ of the outer edge of the blade is changed. FIG. 8-1 is an enlarged vertical section view of a shape of a first example of a front end of the blade. FIG. 8-2 is an enlarged vertical section view of a shape of a front end of a second example of the blade. FIG. 8-3 is an enlarged vertical section view of a shape of a third example of a front end of the blade.

As shown in FIG. 1 and FIG. 3, a multiblade centrifugal blower 1 according to the embodiment includes a scroll casing 4 that has, at a front side, a circular air inlet 4*a* formed of a bell mouth 4*x*, and an air outlet 4*b* on a peripheral part; a centrifugal fan 3 located inside the scroll casing 4 facing the air inlet 4*a*; and a motor 2 fitted in the scroll casing 4 and that rotates the centrifugal fan 3.

The centrifugal fan 3 includes a hub 5 that is mounted on and rotated by a rotation shaft 2*a* of the motor 2, and a plurality of curved flat rectangular blades 6 (see FIG. 2) that are fixed by the rear end to the hub 5, and are arranged at a predetermined angle at equal intervals in a circumferential direction on the periphery of the hub 5, forming a cylindrical basket with an opening on a front side of the hub 5. A ring 7 is fitted to tips of the outer edges of the blades 6 as a blade reinforcing member (the ring 7 can be an integral part of the blades 6). Front part of the blades 6 are fitted in circumferential direction at equal intervals by the ring 7.

When the centrifugal fan 3 is rotated by starting the motor 2, sucked-in air A is sucked in from the air inlet 4*a* of the scroll casing 4, as indicated by dashed line arrows in FIG. 3. The sucked-in air A, coming in from the opening on a front side of the hub in a direction of the rotation shaft 2*a*, is imparted with speed and pressure by a pressurized surface 6*x* (inner curved surface, see FIG. 2; arrow D indicates rotational direction of the centrifugal fan) of the blades 6 of the centrifugal fan 3. The air is discharged in the centrifugal direction through the space in between the blades 6, 6 to the periphery of the centrifugal fan 3, and into a peripheral flow 4*c* inside the scroll casing 4. When the air is in the peripheral flow 4*c*, motion energy of the air is converted into static pressure. The air is then blown out from the air outlet 4*b*.

As shown in FIGS. 1 and 3, the blade 6 according to the embodiment of the present invention is configured such that the length B2 of an outer edge 6*b* of the blade is shorter than a length B1 of an inner edge 6*a* of the blade (tip part of the outer edge 6*b* of the blade is cut at an angle).

As shown in FIG. 3, as inertia is acting on the sucked-in air A inside the centrifugal fan 3 of the multiblade centrifugal blower 1, the sucked-in air A is drawn towards the hub 5 of the centrifugal fan 3. Thus, space between the blades 6, 6 on the side of the air inlet 4*a*, becomes an area of stagnant air, and as shown in FIGS. 3 and 4, reverse flow of air C is generated at the outer edge 6*b* of the blade. When an appropriate part of the tip part of the blade on the outer edge 6*b* of the blade side is cut at an angle, interference between the blades 6 of the centrifugal fan 3 and the reverse flow of the air C is reduced, without any deterioration in blowing performance of the centrifugal fan 3.

For further reduction in the interference between the blades 6 of the centrifugal fan 3 and the reverse flow of the air C, it is better that the area for the reverse flow of the air C is wider. That is, it is preferable that distance between the tip of the blade of the centrifugal fan 3 and the scroll casing 4 is wider. When the appropriate part of the tip part of the blade on the outer edge 6*b* of the blade side is cut at an angle, the distance between the tip of the blade of the centrifugal fan 3 and the scroll casing 4 can be wider, and an adverse effect of a secondary flow can be avoided in the scroll casing 4. Furthermore, actual effective volume of the scroll casing 4 increases and it is possible to maintain and improve the blowing performance of the centrifugal fan 3.

As shown in FIGS. 5-1 to 5-3, as a result of experiments conducted with different relative positions of the tip part of the blades 6 of the centrifugal fan 3 and the bell mouth 4*x*, the bell mouth 4*x* was formed such that the distance from the tip part of the inner edge 6*a* of the blade to the inner wall of the scroll casing 4 is the minimum at an inner tip part P of the bell mouth 4*x* of the air inlet 4*a*. Thus, it was found that noise could be reduced without deterioration in blowing performance of the centrifugal fan 3.

FIG. 6 is a graph of air discharging performance when the length $B_2$ of the outer edge 6*b* of the blade is variously changed, and FIG. 7 is a graph of noise when the length $B_2$ of the outer edge 6*b* of the blade is variously changed.

As shown in FIGS. 6 and 7, in the case of the centrifugal fan 3 according to the embodiment of the present invention, for example, when the length $B_2$ of the outer edge of the blade in correspondence with the length B1 of the inner edge 6*a* of the blade is $B_2/B_1 \approx 0.8$, it is understood that the interference between the blades 6 of the centrifugal fan 3 and the reverse flow of air C is reduced, and the noise is reduced without deteriorating the performance of the centrifugal fan 3.

Furthermore, even when the length $B_2$ of the outer edge 6*b* of the blade in correspondence with the length $B_1$ of the inner edge 6*a* of the blade is $B_2/B_1 \approx 0.7$, the interference between the blades 6 of the centrifugal fan 3 and the reverse flow of air C is reduced, and as shown in FIG. 7, it is understood that there is an air flow zone in which the noise was reduced. However, in such a case, as shown in FIG. 6, blowing performance is deteriorated.

As a result of experiments conducted with different lengths $B_2$ of the outer edge 6*b* of the blade in correspondence with lengths $B_1$ of the inner edge 6*a* of the blade, it was found that when the length $B_2$ of the outer edge 6*b* of the blade in correspondence with the length $B_1$ of the inner edge 6*a* of the blade is $0.75 \leqq B_2/B_1 \leqq 0.95$, the noise is reduced without any substantial deterioration in performance. Thus, it is found that $B_2/B_1 \approx 0.8$ is a preferable value, and the maximum reduction of the noise of about −1 db can be achieved.

Various examples of different shapes of the tip of the blades 6 of the centrifugal fan 3 (end part on the air inlet 4*a* side) are shown in FIG. 8-1 to FIG. 8-3. It is preferable that the length of the outer edge 6*b* of the blade is the maximum and the length of the inner edge 6*a* of the blade is the minimum to achieve the best results in reducing the interference between the blades 6 and the reverse flow of the air C, and eliminating leak of air from the outer edge 6*b* of the blade to the inner edge 6*a* of the blade.

Further, as shown in FIG. 8-1 to FIG. 8-3, it is possible to cut the blade 6 from the inner edge 6*a* of the blade to the outer edge 6*b* in an arbitrary shape such as a straight or curved line.

Furthermore, as shown in FIG. 8-1 to FIG. 8-3, the air sucked in through the air inlet 4*a* hits against the tip part of the inner edge 6*a* of the blade of the blade 6. Therefore, if the tip part has roundness R to control any turbulence or vortex generated in the flow of the sucked-in air, it is possible to reduce noise.

INDUSTRIAL APPLICABILITY

The multiblade centrifugal blower according to the present invention is useful as a blower in a ventilation apparatus, an air conditioning apparatus and the like that are installed in residences, schools, and offices that need quieter environment. Although the explanation above is about the multiblade centrifugal blower with one air inlet, the invention is applicable to a multiblade centrifugal blower with two air inlets.

The invention claimed is:

1. A multiblade centrifugal blower, comprising:

a centrifugal fan that includes:

a hub that is rotated by a motor; and a plurality of curved rectangular blades that are arranged at predetermined intervals in a circumferential direction of the hub to form a cylindrical basket with an opening on a front side of the hub; and a scroll casing that includes an air inlet and an air outlet, and that houses the centrifugal fan inside such that the centrifugal fan faces the air inlet, wherein rotation of the centrifugal fan causes suction of air from the opening and the air inlet toward a direction of a rotating shaft of the motor, and causes discharge of the air through a space between the blades in a centrifugal direction so that the air is blown out from the air outlet, a length $B_2$ from a rear end to a front end of an outer edge of the blade is shorter than a length $B_1$ from a rear end to a front end of an inner edge of the blade, a bell mouth is located at the air inlet such that a distance from a tip part of the inner edge of the blade to an inner wall of the scroll casing is minimum at an inner tip part of the bell mouth, and wherein a ratio $B_2/B_1$ satisfies $0.75 \leqq B_2/B_1 \leqq 0.95$.

2. The multiblade centrifugal blower according to claim 1, wherein an edge from the tip part of the inner edge of the blade to a tip part of the outer edge of the blade is shaped into a straight line.

3. The multiblade centrifugal blower according to claim 1, wherein an edge from the tip part of the inner edge of the blade to a tip part of the outer edge of the blade is shaped into a curved line.

4. The multiblade centrifugal blower according to claim 1, wherein the tip part of the inner edge of the blade is rounded.

5. A multiblade centrifugal blower, comprising:

a centrifugal fan that includes:

a hub that is rotated by a motor; and a plurality of curved rectangular blades that are arranged at predetermined intervals in a circumferential direction of the hub to form a cylindrical basket with an opening on a front side of the hub; and a scroll casing that includes an air inlet and an air outlet, and that houses the centrifugal fan inside such that the centrifugal fan faces the air inlet, wherein rotation of the centrifugal fan causes suction of air from the opening and the air inlet toward a direction of a rotating shaft of the motor, and causes discharge of the air through a space between the blades in a centrifugal direction so that the air is blown out from the air outlet, a length $B_2$ from a rear end to a front end of an outer edge of the blade is shorter than a length $B_1$ from a rear end to a front end of an inner edge of the blade, a bell mouth is located at the air inlet such that a distance from a tip part of the inner edge of the blade to an inner wall of the scroll casing is minimum at an inner tip part of the bell mouth, and wherein a ratio $B_2/B_1$ is $B_2/B_1 \approx 0.8$.

6. The multiblade centrifugal blower according to claim 5, wherein an edge from the tip part of the inner edge of the blade to a tip part of the outer edge of the blade is shaped into a straight line.

7. The multiblade centrifugal blower according to claim 5, wherein an edge from the tip part of the inner edge of the blade to a tip part of the outer edge of the blade is shaped into a curved line.

8. The multiblade centrifugal blower according to claim 5, wherein the tip part of the inner edge of the blade is rounded.

9. A multiblade centrifugal blower, comprising:

a centrifugal fan that includes:

a hub that is rotated by a motor; and a plurality of curved rectangular blades that are arranged at predetermined intervals in a circumferential direction of the hub to form a cylindrical basket with an opening on a front side of the hub; and a scroll casing that includes an air inlet and an air outlet, and that houses the centrifugal fan inside such that the centrifugal fan faces the air inlet, wherein rotation of the centrifugal fan causes suction of air from the opening and the air inlet toward a direction of a rotating shaft of the motor, and causes discharge of the air through a space between the blades in a centrifugal direction so that the air is blown out from the air outlet, a length $B_2$ from a rear end to a front end of an outer edge of the blade is shorter than a length $B_1$ from a rear end to a front end of an inner edge of the blade, a bell mouth is located at the air inlet such that a distance from a tip part of the inner edge of the blade to an inner wall of the scroll casing is minimum at an inner tip part of the bell mouth, and wherein the tip part of the inner edge of the blade is rounded.

10. The multiblade centrifugal blower according to claim 9, wherein an edge from the tip part of the inner edge of the blade to a tip part of the outer edge of the blade is shaped into a straight line.

11. The multiblade centrifugal blower according to claim 9, wherein an edge from the tip part of the inner edge of the blade to a tip part of the outer edge of the blade is shaped into a curved line.

* * * * *